US008066212B2

(12) United States Patent
Pallmann

(10) Patent No.: US 8,066,212 B2
(45) Date of Patent: Nov. 29, 2011

(54) ROTOR AND DEVICE FOR THE COMMINUTION OF INPUT MATERIAL

(75) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 67 days.

(21) Appl. No.: 12/400,517

(22) Filed: Mar. 9, 2009

(65) Prior Publication Data

US 2009/0224089 A1 Sep. 10, 2009

(30) Foreign Application Priority Data

Mar. 7, 2008 (DE) ..... 10 2008 013 232

(51) Int. Cl.
*B02C 13/00* (2006.01)

(52) U.S. Cl. ..... 241/191; 241/195; 241/295

(58) Field of Classification Search ..... 241/191, 241/194, 195, 295
See application file for complete search history.

(56) References Cited

U.S. PATENT DOCUMENTS

| | | | | | |
|---|---|---|---|---|---|
| 3,680,797 | A | * | 8/1972 | Covey | 241/73 |
| 3,779,470 | A | * | 12/1973 | Smits | 241/191 |
| 4,077,573 | A | * | 3/1978 | Kersey et al. | 241/32 |
| 4,368,764 | A | * | 1/1983 | Peterson et al. | 144/208.7 |
| 4,895,309 | A | * | 1/1990 | Fritz | 241/185.5 |
| 4,925,114 | A | * | 5/1990 | Ostergaard | 241/191 |
| 4,934,611 | A | * | 6/1990 | Lewis | 241/36 |
| 4,997,136 | A | * | 3/1991 | Becker | 241/194 |
| 5,372,316 | A | * | 12/1994 | Bateman | 241/191 |
| 5,381,973 | A | | 1/1995 | Hemesath | |
| 6,042,035 | A | * | 3/2000 | Grobler et al. | 241/191 |
| 6,045,072 | A | * | 4/2000 | Zehr | 241/189.1 |
| 6,237,865 | B1 | | 5/2001 | Luttermann et al. | |
| 2008/0135658 | A1 | | 6/2008 | Pallmann et al. | |

FOREIGN PATENT DOCUMENTS

WO WO 2006/064483 A2 6/2006

OTHER PUBLICATIONS

Merriam-Webster Dictionary Online. http://www.merriam-webster.com/dictionary/clamp, Retreived on Mar. 24, 2011.*

* cited by examiner

*Primary Examiner* — Bena Miller
(74) *Attorney, Agent, or Firm* — Muncy, Geissler, Olds & Lowe, PLLC

(57) ABSTRACT

A rotor and device for the comminution of input material is provided. The rotor includes a drive shaft on which a predetermined number of rotor discs are provided and over the circumference of which grinding tools are arranged. In accordance with an embodiment, it is provided that frictional connection elements are arranged between the rotor discs forming axial ends of the rotor and the shaft for transferring a torque, and that power transmission elements are arranged in a contact surface of two adjacent rotor discs and that the rotor discs can be clamped together with axially acting clamping elements.

20 Claims, 4 Drawing Sheets

ROTOR AND DEVICE FOR THE COMMINUTION OF INPUT MATERIAL

This nonprovisional application claims priority under 35 U.S.C. §119(a) to German Patent Application No. 10 2008 013 232, which was filed in Germany on Mar. 7, 2008, and which is herein incorporated by reference.

BACKGROUND OF THE INVENTION

1. Field of the Invention

The present invention relates to a rotor for the comminution of input materials and a device with such a rotor.

2. Description of the Background Art

In the comminution of materials, devices with a grinding unit comprising a rotor have proven to be useful. The rotor is essentially made up of a shaft and rotor discs arranged on it, with the grinding tools distributed over the circumference of the discs. The grinding tools can be made from knives, rigid or swinging suspended hammers, cutting tools or the like. As a rule, the rotor has assigned to it a stator, which is equipped with counter-knives, impact surfaces or screening surfaces, or an additional rotor, the rotor discs of which interact with the rotor discs of the first rotor. The input material is supplied radially to the rotor, where it is picked up by the grinding tools and ground in conjunction with the stator tools or the second rotor.

The materials that can be input into such a generic device are of many types and range from, for example, all types of plastics to sheet metals, textiles and electronic wastes, through composite materials and used tires. Depending on the nature of the input material in terms of size, shape and material properties, the rotor is exposed to high mechanical resistance during the grinding operation, so that the power transmission from the drive shaft to the rotor disc is of great significance.

A modular rotor design with a certain number of rotor discs fastened removably on the shaft plays a great role from the view point of rotor assembly, but also during the replacement of damaged or worn rotor discs, since if necessary the rotor can be disassembled into smaller components, which on one hand are easier to handle and on the other hand can be systematically replaced. Such a rotor design, however, especially in conjunction with a force-locking frictional connection between the drive shaft and the end-positioned rotor discs, requires that the drive force can be transmitted reliably and without slippage from one rotor disc to the next.

From WO 2006/064483 A2, a device for grinding elastomers is known, the grinding unit is formed by two rotors that are provided with corrugations over their circumference. The rotors essentially are each formed from a hollow cylinder, the axial ends of which are screwed together with coaxial supporting discs, which in turn are positioned in a rotationally fixed manner on a driven truncated shaft. The rotor thus has no continuous drive shaft.

A rotor of similar design is known from DE 199 28 034 A1, which corresponds to U.S. Pat. No. 6,237,865, and in which instead of a continuous shaft, likewise only truncated shafts are attached on the front faces of the rotor. Otherwise the rotor is formed from coaxially joined discs which are connected with one another axially over longitudinal bars.

These design types of rotors always prove disadvantageous if an axially compressed design is important because of space conditions. The attachment of the supporting discs to the face of the rotor increases the rotor length without achieving an increase in the effective working area for grinding. In addition, such a design is relatively expensive to manufacture and assemble and in the case of manufacturing and assembly inaccuracies, rapidly leads to imbalance of the rotor and losses of round. Furthermore in the case of overload on the rotor, for example if it is blocked because of unintended foreign body input, considerable damage to the grinding unit takes place, since absolute force locking is produced between the drive side and rotor.

An alternative solution for transmitting the driving power from the shaft to the disc is disclosed in DE 39 30 041 A1. There a continuous drive shaft is formed in the area of the seat of the rotor disc with a hexagonal cross-section. The discs have a centric opening complementary to this, so that power transmission from the shaft to the rotor disc is guaranteed by the form locking. A different type of form locking for power transmission is known from DE 94 22 104 U1. The embodiment described there has a drive shaft with axial grooves on its external circumference, which together with corresponding axial grooves on the inner circumference of the individual discs results in a composite cross-section, into which an adjusting spring is placed.

These two solutions also result in absolute force locking between the drive shaft and the rotor disc, so that in the case of overload on the device, damage to the grinding unit is to be feared. Furthermore, the formation of accurately fitting grooves on the shaft and rotor discs implies a considerable increase in costs for manufacturing and assembly.

Furthermore it is known that the drive force can be transferred from the drive shaft to the rotor disc by frictional connection. Both EP 0 019 542 A1 and U.S. Pat. No. 5,381,973 disclose friction or clamping devices for this purpose, which in each case are arranged in an annular recess on the outside of the front face of the rotor disc and surround the drive shaft, producing a frictional connection. For further power transmission of the torque to the inner rotor discs, both documents disclose that adjacent rotor discs are welded together, in other words all rotor discs are permanently bound to one another and thus form a rigid rotor unit.

U.S. Pat. No. 5,381,973 additionally discloses axial centering pins in the contact area of two adjacent rotor discs, which ensure that the individual rotor discs sit in the exactly identical position to one another on the drive shaft. This is significant when assembling the rotor in that the through holes provided in the outer circumferential area must fit exactly in the axial direction so that later the shafts can be slid in without problems for a swinging suspension of hammers. Furthermore it is suggested that the centering pin be replaced by temporary longitudinal rods until the rotor discs are finally connected together by weld seams.

Although the welding together of the rotor discs results in reliable power transmission of the driving torque into all rotor discs, it has the drawback that all rotor discs form a rigid, non-removable rotor unit which is difficult to handle in the case of disassembly or repairs.

SUMMARY OF THE INVENTION

It is therefore an object of the present invention to improve rotors and devices with regard to the above-described disadvantages; in particular, a rotor in accordance with the invention should permit a compact design, precise grinding and safe, economical operation.

The invention leads to an accurately operating rotor, protected against overload and extremely compact in design, which is nevertheless able to be easily separated into its components for assembly, disassembly, repair or maintenance.

The power transmission from the drive shaft to the rotor discs can be accomplished by a frictional connection. In this way the maximum transmissible power can be adjusted by suitable design, depending on the material pairing involved in the frictional disc, the available frictional connection surface, and the contact pressure at the contact surface. The maximum transmissible power corresponds to the force that just fails to lead to damage to the grinding device in the case of a sudden change in speed of the rotor. If this power is exceeded, for example when foreign objects in the input material block the rotor, thanks to the invention, before damage occurs to the rotor, slippage takes place between the rotor discs and the drive shaft. This has the enormous advantage of considerably reducing the risk of damage for the operators of devices in accordance with the invention.

Since not all rotor discs are frictionally connected to drive shafts in a rotor in accordance with the invention, but only those on the rotor ends, the invention additionally comprises power transmission elements operating in the tangential direction and axially acting tension elements to transfer the driving torque from one rotor disc to the next rotor disc in a precise position of the rotor discs relative to one another.

The frictional connection elements of the device in accordance with the invention are advantageously arranged in the interior of the outer rotor discs so that a minimal design length in the axial direction results, which on the whole is helpful for compact design of devices in accordance with the invention.

Since in drive shafts in accordance with the invention it is possible to dispense with form-locking surfaces of complementary design for achieving a form-locking connection between the drive shaft and rotor discs, it is possible to produce drive shafts in accordance with the invention easily, quickly, and thus economically.

According to an embodiment of the invention, the frictional connection elements include clamping sets that are freely available on the market. Therefore these contribute further to reducing the manufacturing costs. By using several clamping sets arranged in the axial direction from one another, the magnitude of the power to be transferred can be set in advance.

In an embodiment of the invention the clamping elements acting in the axial direction are formed by a shaft nut which, when screwed onto the shaft, clamps the rotor discs against an annular stop or an additional shaft nut at the other end of the shaft. Another embodiment of the invention in this regard provides axial clamping anchors that penetrate the rotor discs in the axial direction and thus are located in the interior of the rotor. Since the clamping anchors can be sunk in the anchoring area in the front faces of the rotor, here also a minimal construction length of the rotor is favored, so that this exemplified embodiment can be specially combined with the aforementioned clamping sets to achieve a compact design.

The power transmission elements each can have a 3-dimensional body arranged in a cavity formed within the contact joint of two adjacent rotor discs. In this way, a toothed connection of two rotor discs is achieved to permit transfer of the driving torque. A 3-dimensional body can be formed, for example, from a pin, a disc or a strip.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
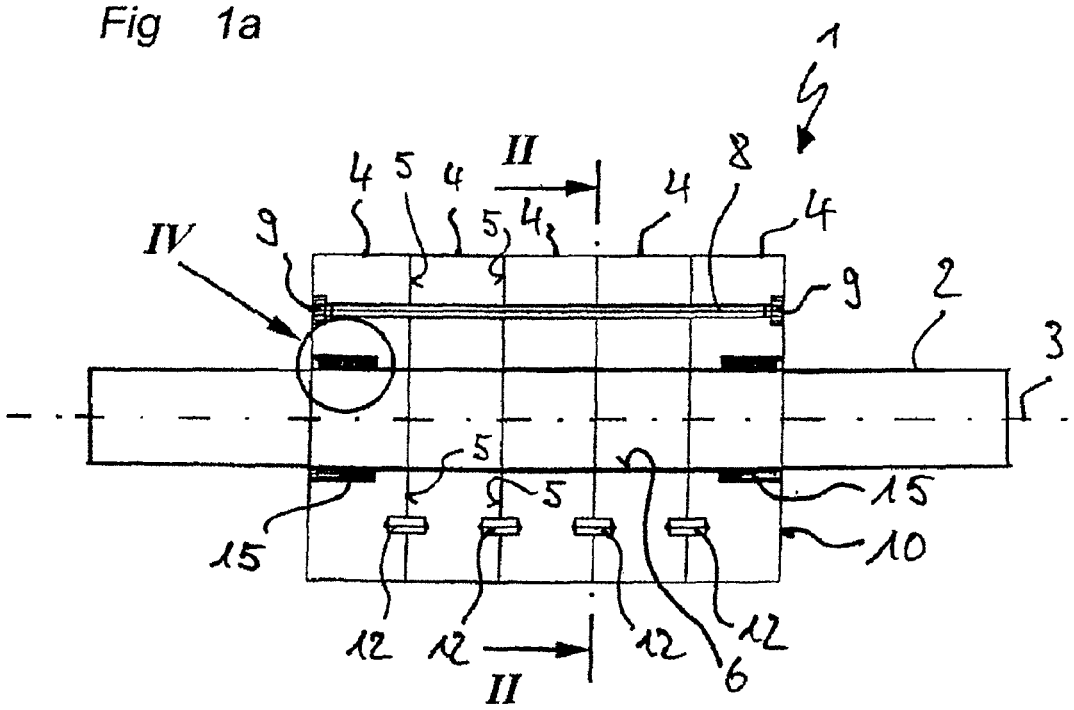
FIG. 1*a* is a longitudinal section through a first embodiment of a rotor in accordance with the invention.

FIGS. 1*a,* 2*a* and 2*b* show a first embodiment of a rotor 1 in accordance with the invention, which for example is suitable for accomplishing the size reduction of input materials of a wide range of types within a shredder or a cutting mill. A device suitable for the use of rotor 1 is, for example, described in DE 102006056542 A1, which corresponds to U.S. Publication No. 20080135658, the entire content of which is incorporated herein by reference.

The rotor 1 shown in FIG. 1*a* has a continuous drive shaft 2 with a longitudinal axis 3, the free ends of which are intended to be retained rotatably in axial bearings of the device, not shown. In the operation of the device in accordance with the invention, the drive shaft 2 is impinged with a driving torque to generate a rotational motion. In the center region on the drive shaft 2, in a coaxial arrangement, five successive rotor discs 4 are placed, the front faces 5 of which are in contact with one another.

Figure 2A:
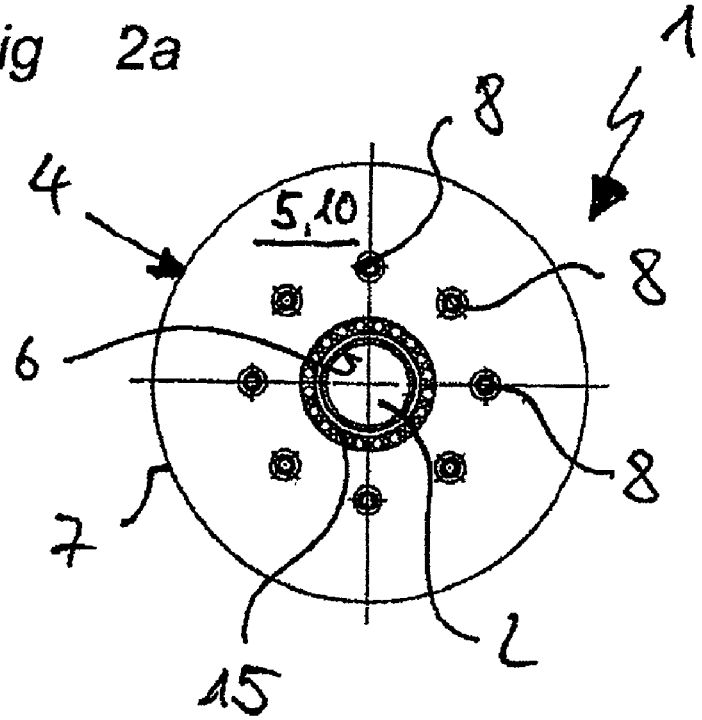
FIG. 2*a* is an axial view of the rotor shown in FIG. 1*a;*
Figure 2B:
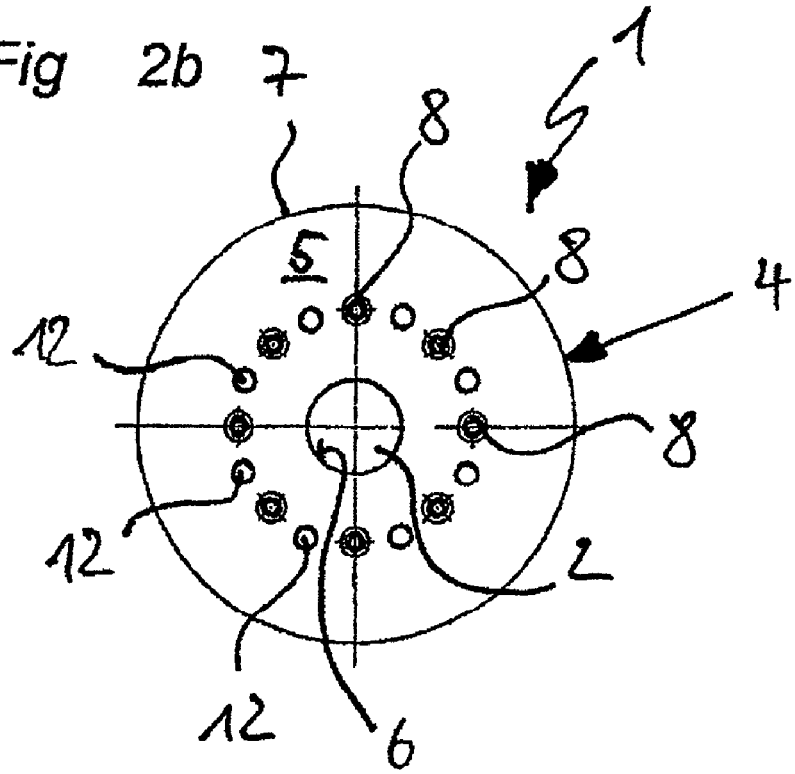
FIG. 2*b* is a cross-section through the rotor shown in FIG. 1*a* along the line II-II.

As is apparent from FIGS. 2*a* and 2*b,* the rotor discs 4 have a circular shape with a central opening 6 that corresponds approximately to the external diameter of the drive shaft 2 and thus makes possible the seating of the rotor discs 4 on the shaft 2. An external circumference 7 of the rotor discs 4 is provided with processing tools, not shown, which for example may be formed from knives, strips, ripple plates, teeth, shear tools, swinging or rigid hammers and the like.

It is apparent from FIG. 1*a* that the individual rotor discs 4 can be clamped together over several tension anchors 8, parallel to the axis, in uniform circumferential distances on a circumferential circle arranged concentrically to the longitudinal axis 3. The radial distance from tension anchor 8 to the longitudinal axis 3 can be such that the tension anchors 8 are located in the center between the edge of the opening 6 and the outer circumference 7. In the case of a greater radial distance, the tension anchors 8 are located in the external half of the rotor discs 4. The clamping nuts 9 necessary for producing the clamping force are located, for example in this embodiment, completely within indentations on the rotor front faces 10.

Figure 1B:
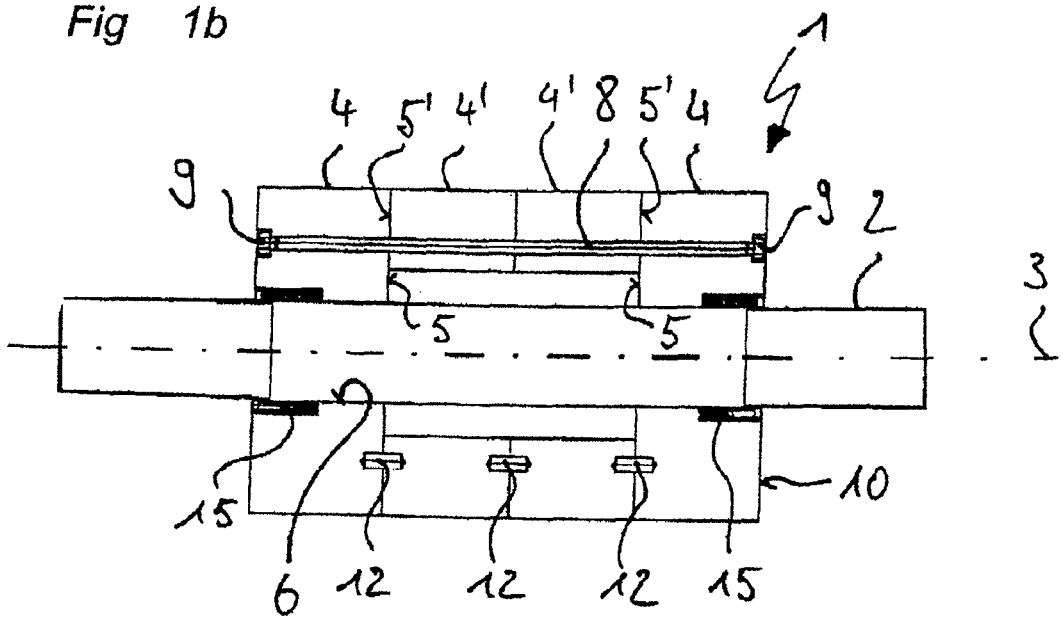
FIG. 1*b* is a longitudinal section through a second embodiment of a rotor in accordance with the invention.

It is apparent from FIG. 1*b* that the inner rotor discs 4' may also be shaped as annular discs with such a large centric opening 6' that the rotor discs 4' are only positioned with their front faces 5' adjacent to one another and without direct contact with the drive shaft 2. Such a rotor 1 is characterized by a savings of material and weight and easier assembly.

To ensure the power transmission between adjacent rotor discs 4, 4' during the grinding operation, respective power transmission elements are arranged in the contact joints of two rotor discs 4, 4'.

Figure 3A:
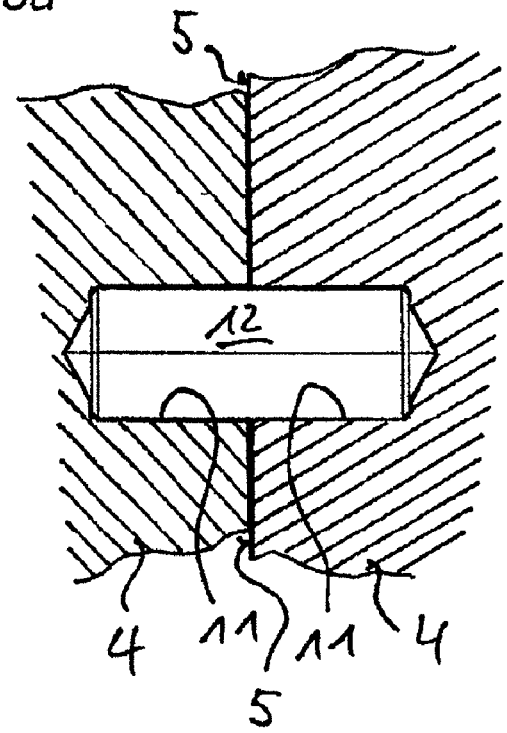
FIG. 3*a* is a partial section in the contact area of two rotor discs with a first embodiment of power transmission elements.
Figure 3B:
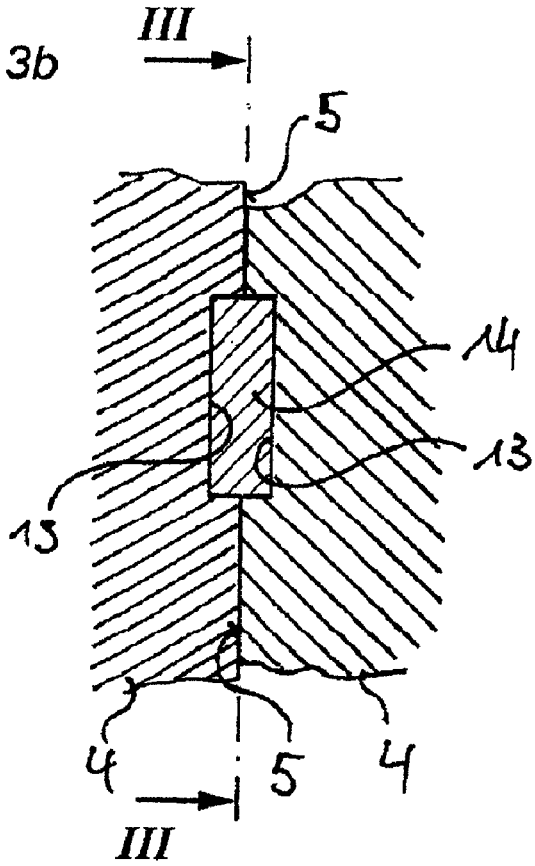
FIG. 3*b* is a partial section in the connecting region of two rotor discs with a second embodiment of power transmission elements.
Figure 3C:
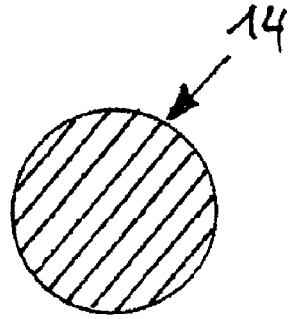
FIG. 3*c* is a partial section through the power transmission elements shown in FIG. 3*b* along the line III-III.

FIGS. 3*a* to 3*c* show two different forms of embodiment of suitable power transmission elements. In FIG. 3*a* the power transmission elements are formed by bore holes 11, which emerging from the front faces 5, 5' in the axial direction are introduced into the rotor discs 4, 4'. In this process the holes 11 of two adjacent rotor discs 4, 4' are located axially opposite one another. In the total cavity formed by the holes 8, pins 12 are inserted in a form-locking manner as power transmission elements.

The power transmission elements according to FIG. 3*b* include circular indentations 13 in the front faces 5, 5' of the rotor discs 4, 4', which in turn are axially opposite one another in pairs. The force connection is accomplished with the aid of discs 14, which completely fill the cavity formed by two indentations 13. On the outer circumference the discs 14, proceeding from the center plane toward their free ends, may respectively be slightly tapered to facilitate assembly and disassembly. The power transmission takes place by way of the circumferential surfaces of the indentations and discs, which work together for this purpose.

One possible arrangement of the power transmission elements with regard to the longitudinal axis 3 is apparent from FIG. 2*b*. There it is possible to recognize that the power transmission elements can fall on a circumferential circle with the tension anchors 8 and in each case can be arranged in the center between two tension anchors 8.

According to a further embodiment of the invention, not shown, the power transmission elements includes annular grooves in the front faces 5, 5', which interact with rings shaped in a complementary manner. The advantage of this embodiment is in the possibility of in each case arranging the annular grooves and rings concentrically around the tension anchor 8, resulting in a highly space-saving mode of action, which comes into play especially in the case of rotors with small diameters.

Likewise not shown is an embodiment in which the power transmission elements have radially extending grooves in the front face of a rotor disc, into which complementary shaped, radially positioned strips mesh into the corresponding front face of an adjacent rotor disc.

All described types of power transmission elements lead to an intermeshing between the individual rotor discs 4, 4', as a result of which together with the tension anchors 8 a quasi-monolithic, but nevertheless separable structure is formed, sitting on the drive shaft 2.

Figure 4A:
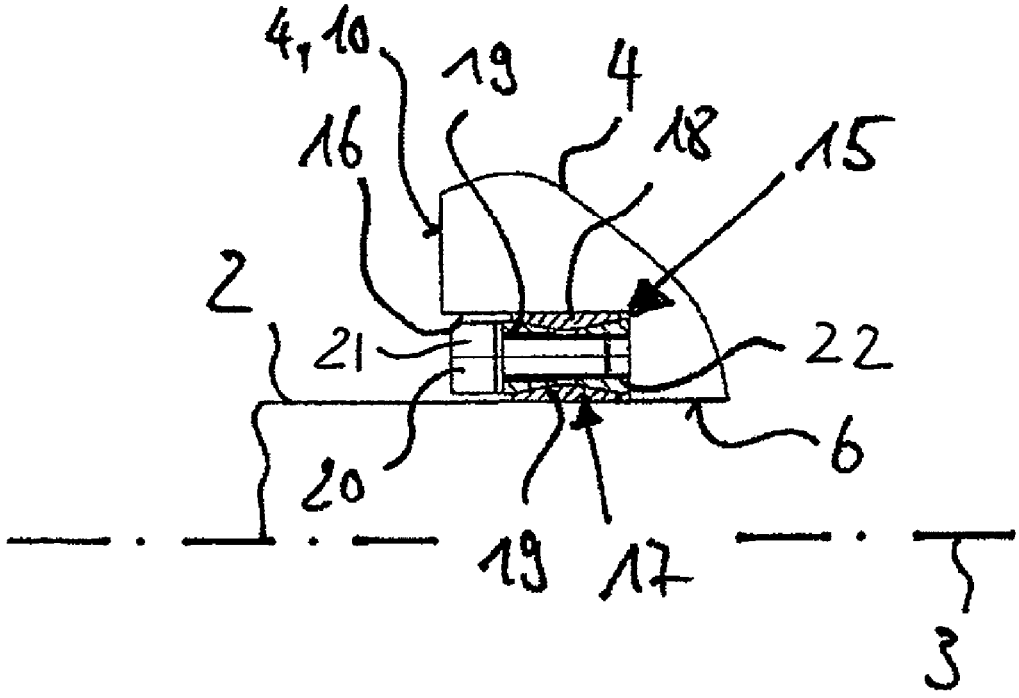
FIG. 4*a* is a partial section through the power transmission region between rotor disc and drive shaft according to a first embodiment.

Frictional connection elements in the form of one or more clamping sets 15 serve to transfer the driving forces from the drive shaft 2 to the rotor discs 4, 4'. FIG. 4*a* shows the relevant area in a partial section. Here it is apparent that the rotor discs 4 in the area of the opening 6 starting from the rotor front side 10 in each case have a recess 16. The recess 16 is intended for accommodating one or more clamping sets 15. Each clamping set 15 has a pressure sleeve 17 with an outer pressure ring 18, which lies against the rotor disc 4 and is adjacent to a pressure ring 19 arranged in the radial direction for that purpose, located on the circumference of the drive shaft 2. Both pressure rings 18 and 19 over their axial length have a wall conically thickened in the center area, so that an annular space of double concave cross-section results.

In this annular space, axially opposite tapered rings 20 and 21 are placed, the tapered surfaces of which interact with the oblique insides of the pressure rings 18 and 19. The two tapered rings 20 and 21 are penetrated by a plurality of clamping screws 22, wherein a relative movement of the tapered ring 20 in the direction of the tapered ring 21 is initiated by tightening the clamping screws 22. As a result, radial spreading of the pressure sleeve 17 takes place, and thus the production of a frictional connection in the contact surfaces between the pressure sleeves 17 and the drive shafts 2 on one hand and the pressure sleeves 17 and the rotor shaft 4 on the other hand.

The frictional force arising as a consequence of the radial pressure, the size of the power transmission surface and the coefficient of friction can be transferred as a maximum driving torque to the rotor discs 4. By suitably tightening the clamping screws 22 it is thus possible to set the maximum force that can be transferred to the rotor discs 4 by the drive shaft 2. If this force is exceeded, for example by blockage of the rotor disc 4, this force is exceeded, and slippage occurs between the drive shaft 2 and rotor discs 4, preventing major damage to the rotor 1.

Figure 4B:
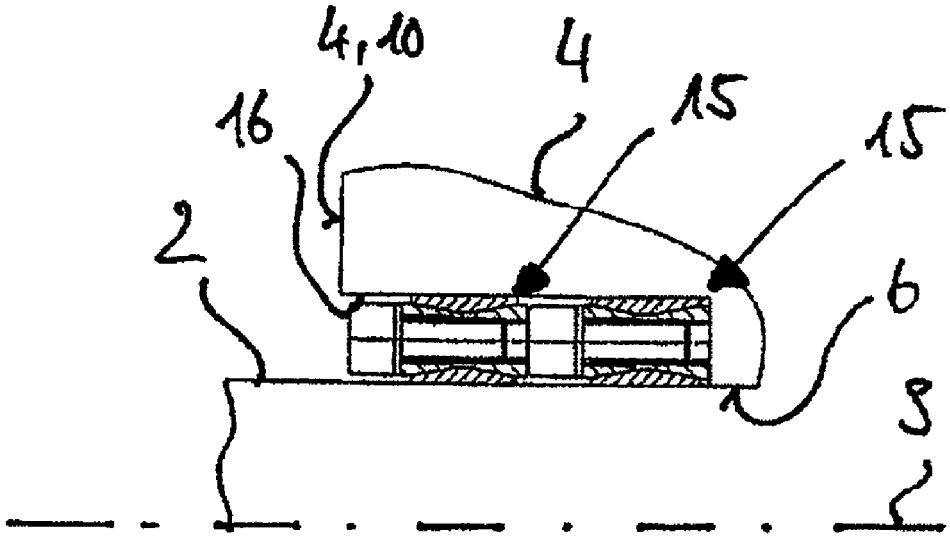
FIG. 4*b* is a partial section through the power transmission region between rotor disc and drive shaft according to a second embodiment.

The embodiment of a rotor 1 shown in FIG. 4*b* differs from that previously described only through the use of clamping sets 15, which are arranged successively in the axial direction. Through the use of several clamping sets 15 it is possible to increase the maximum driving power that can be exerted by the drive shaft 2 on the rotor disc 4.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A rotor for a device for the comminution of input material, the device having a drive shaft on which a predetermined number of rotor discs are positioned in a rotationally fixed manner and having grinding tools arranged about a circumference of the rotor discs, wherein, between the rotor discs forming axial ends of the rotor and the drive shaft for transferring a torque, frictional connection elements are arranged, wherein power transmission elements are arranged in the contact surface between two adjacent rotor discs, and wherein the rotor discs are clamped together with axially acting clamping elements that provide a clamping force between adjacent rotor discs, wherein at least two adjacent rotor discs are not welded together.

2. The rotor according to claim 1, wherein the frictional connection elements include at least one clamping set.

3. The rotor according to claim 2, wherein a plurality of clamping sets are arranged in axial succession to preset the transmissible torque.

4. The rotor according to claim 1, wherein the clamping elements are formed by tension anchors, which penetrate the rotor discs axially.

5. The rotor according to claim 4, wherein the tension anchors are arranged on a common circumferential circle around a longitudinal axis.

6. The rotor according to claim 5, wherein the tension anchors are arranged at a radial distance from the longitudinal axis in such a way that the tension anchors are located centrally between the circumference and an edge of the central opening of the rotor discs.

7. The rotor according to claim 1, wherein heads of the tension anchors are sunk into a respective front face of the end rotor discs.

8. The rotor according to claim 1, wherein the clamping element are formed by a shaft nut at one end of the rotor and an axial stop at the other end of the rotor, and wherein the rotor discs are configured to be clamped against the axial stop by a shaft nut.

9. The rotor according to claim 1, wherein the power transmission elements includes pins, rings, strips or discs, which, emerging from the contact surface between two adjacent rotor discs, extend into complementary indentations in one as well as the other rotor disc.

10. The rotor according to claim 9, wherein the power transmission elements are tapered toward their axial ends.

11. The rotor according to claim 9, wherein the power transmission elements are arranged on a joint circumferential circle around the longitudinal axis.

12. The rotor according to claim 9, wherein the power transmission elements are located in a tangential direction, in each case, in a center between two adjacent tension anchors.

13. The rotor according to claim 9, wherein the power transmission elements have an annular shape and each concentrically surround a tension anchor.

14. A device for the comminution of input material with a comminution unit, wherein the comminution unit has a rotor in accordance with claim 1.

15. The rotor according to claim 1, wherein the at least two adjacent rotor discs not welded together are detachable from one another by releasing one or more of the axially acting clamping elements.

16. An apparatus for the comminution of input material, comprising:

a plurality of rotor discs configured to receive one or more grinding tools;

frictional connection elements configured to transfer torque from a drive shaft to the rotor discs via axial end rotor discs among the plurality of rotor discs;

power transmission elements arranged between adjacent rotor discs and configured to transmit power between the rotor discs; and axially acting clamping elements configured to provide an axial clamping force between adjacent rotor discs to clamp the rotor discs together, wherein the clamping elements are releasable, and wherein at least two adjacent rotor discs are detachable from one another by the release of one or more of the clamping elements.

17. The apparatus according to claim 16, wherein the clamping elements are formed by tension anchors configured to penetrate the rotor discs axially.

18. The apparatus or according to claim 17, wherein heads of the tension anchors are sunk into a respective front face of the end rotor discs.

19. The apparatus according to claim 16, wherein the clamping elements are formed by a shaft nut at one end of the plurality of rotor discs and an axial stop at the other end of the plurality of rotor discs, and wherein the rotor discs are configured to be clamped against the axial stop by the shaft nut.

20. The apparatus according to claim 16, wherein the power transmission elements include pins, rings, strips or discs, which, emerging from the contact surface between two adjacent rotor discs, extend into complementary indentations in one as well as the other rotor disc.

* * * * *